United States Patent [19]

Owen

[11] 4,037,080

[45] July 19, 1977

[54] PROTECTION AND CONTROL OF ELECTRIC IMMERSION-TYPE HEATER

[76] Inventor: Donald R. Owen, 211 N. Lincoln St., Hinsdale, Ill. 60521

[21] Appl. No.: 647,099

[22] Filed: Jan. 7, 1976

[51] Int. Cl.[2] ..... F24H 1/00; H05B 1/00

[52] U.S. Cl. ..... 219/328; 219/316; 219/318; 219/320; 219/322; 219/323; 219/335; 219/337; 219/481

[58] Field of Search ..... 219/328, 327, 335–337, 219/324, 323, 322, 321, 320, 318, 316, 315, 481–483, 523

[56] References Cited

U.S. PATENT DOCUMENTS

| | | | |
|---|---|---|---|
| 2,916,598 | 12/1959 | Hayden | 219/321 X |
| 3,082,915 | 3/1903 | Karlen et al. | 219/324 X |
| 3,134,008 | 5/1964 | Finn | 219/316 X |
| 3,187,161 | 6/1965 | Finn | 219/318 X |
| 3,357,421 | 12/1967 | Hatch | 219/328 UX |

FOREIGN PATENT DOCUMENTS

| | | | |
|---|---|---|---|
| 1,170,763 | 11/1969 | United Kingdom | 219/328 |
| 807,556 | 1/1959 | United Kingdom | 219/328 |
| 744,181 | 2/1956 | United Kingdom | 219/328 |

*Primary Examiner*—C. L. Albritton

*Attorney, Agent, or Firm*—Hill, Gross, Simpson, Van Santen, Steadman, Chiara & Simpson

[57] ABSTRACT

A flexible, rope-type heat sensor interfaces in a overlapping array with exposed outer portions of U-shaped heating elements of an immersion-type heater. The sensor is connected to a controller which opens and closes circuitry connecting the heater with a power source upon selectively sensing a temperature condition of the heater elements. With such a heater installed in a liquid-containing receptacle, the temperature of the liquid can be controlled and the heater protected from inadvertent overheating. The device is also applicable to control liquid level in a receptacle.

8 Claims, 3 Drawing Figures

19
18
17
17a
10
34
37,38
35
36
25a
24a
11
12
23
26a
27,31
29,30
22
25b
24b
33
26b
28,32
20
21
15
14
16
35

S
S'
40
44
41
43
42
45
37
38
36
39
35
27
31
11
13
30
33
29
32
28
12

S
S'
19'
L
10
43
45
48
46
V
47
49

PROTECTION AND CONTROL OF ELECTRIC IMMERSION-TYPE HEATER

BACKGROUND OF THE INVENTION

1. Field of Invention

This invention relates to immersion-type heaters for installation in an appropriate receptacle containing a liquid medium to be heated by the heater. Temperature of the liquid medium is controlled by sensing the temperature of heating elements of the heater and selectively closing and opening circuitry connecting the heater to a power source while at the same time the heater is protected from destructive self-generated temperatures.

2. Description of the Prior Art

Heretofore, immersion-type heaters for use within a receptacle to heat a contained liquid within that receptacle used sensing means either to control the temperature of the liquid only or to protect the heater from reaching excessive sheath temperatures only, but not both simultaneously.

Prior sensing of excessive temperatures (caused by either low liquid level, excessive mineral deposit accumulations, or "coking" of oil-base liquids) was accomplished with the sensor extending through the mounting means into the liquid medium. This required removal of the heater (after draining the liquid medium from the tank) to replace a defective or damaged sensor.

SUMMARY OF THE INVENTION

An immersion-type heater having a threaded engaging plug or flange is conveniently installed in a like threaded aperture in a wall of a tank or other like receptacle for heating therein a contained liquid. The heater comprises a set of U-shaped heating elements contained by the plug or flange projecting inwardly into the tank and outwardly to the other side of the engaging plug or flange. The elements through a terminal portion are connected to a power source through a power circuit.

The outer exposed portion of the heating elements interfaces with a flexible, rope-type sensor arranged in an inter-lacing or wrapped around manner, i.e. in reversing and overlapping array, so as to be in substantial contact with the outer surface or sheath portion of the heater elements. The temperature of this outer sheath is sensed by the sensor which in turn is connected to a controller device. The controller has an output terminal in turn connected to a power supply relay for opening and closing the power circuit between the power source and the terminals of the heating element.

This system has several distinct advantages. First, the temperature of the liquid medium is controlled by sensing the temperature of the heater elements outside the receptacle holding the liquid. Second, if the inner portion of the heating elements extending into the tank, is not properly surrounded by liquid, i.e. covered with excessive scale or "dry fired", the heating element quickly heats to a higher temperature than desired since there is no surrounding liquid to which heat can be transferred. The rope sensor quickly responds to this undesirable condition and the power supply circuit is opened by activation of the power relay connected to the controller upon receiving an out-of-limit condition signal from the sensor.

Third, by using a sensor in the form of a flexible rope, it is possible to maintain extensive and intimate contact between the exposed sheath portion of each individual element in that the sensor is interlaced or wrapped around all the elements. Fourth, this arrangement allows installation of the heater without need of the sensing means being oriented to a particular position as on the top of the heater.

A fifth advantage is that the sensor is mounted on the heater itself. No additional holes or tank fittings to recieve a sensor or liquid level float is required.

Sixth, because of the external location of the sensor, it is not subject to any corrosive or contaminating characteristics of the contained liquid; and seventh, if replacement of a sensor should be required, this work can be performed without disturbing the contents of the tank.

DETAILED DESCRIPTION OF THE DRAWINGS

DESCRIPTION OF THE PREFERRED EMBODIMENT

Figure 1:
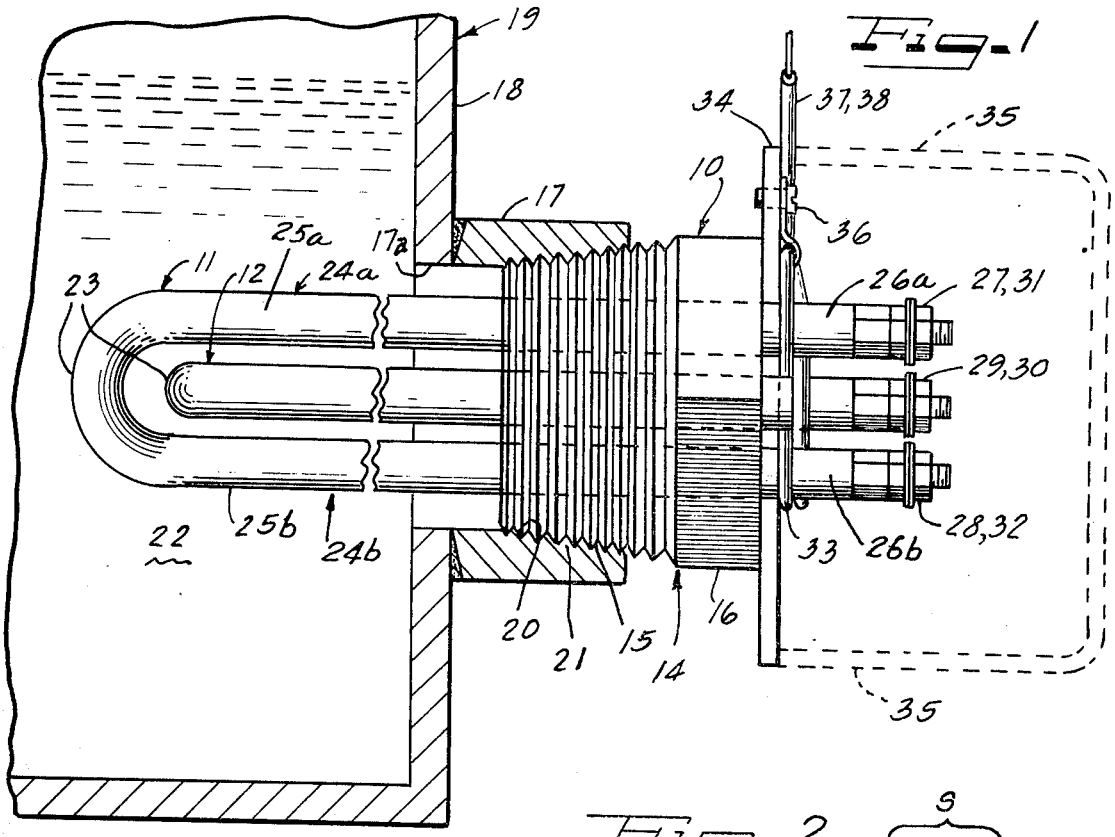
FIG. 1 is a cross-sectional elevational view of a heater with a sensor attached thereto installed in a liquid container.

An immersion-type heater is shown generally at 10 having three U-shaped heating elements 11, 12 and 13 supported in a mounting plug 14 having an inner end threaded attachment portion 15 and an outer end wrench-faced gripping portion 16. The plug 14 is threadedly secured into an outwardly protruding nipple 17 about an opening **17*a* in a vertical wall 18 of an appropriate receptacle or tank 19. The protruding nipple 17 has internal threads 20 with which the portion 15 forms a seal 21 preventing leakage of a liquid 22 from within the container 19.**

Each heating element 11, 12 and 13 is of generally U-shape and comprises a typical respective loop portion 23 and typical respective pair of joined legs **24*a* and 24*b*. The elements 11, 12 and 13 are so mounted in the plug or flange 14 that when installed in the tank 19, the loop portions 23 and an inner portion 25*a* and 25*b* of each leg 24*a* and 24*b* are exposed to the surrounding liquid 22. Each leg 24*a* and 24*b* has a typical outer portion 26*a* and 26*b* extending outwardly from the outer end of the plug or flange 14. Respective terminals 27, 28, 29, 30, 31 and 32 are located at the ends of the legs on the elements 11, 12 and 13.**

Figure 2:
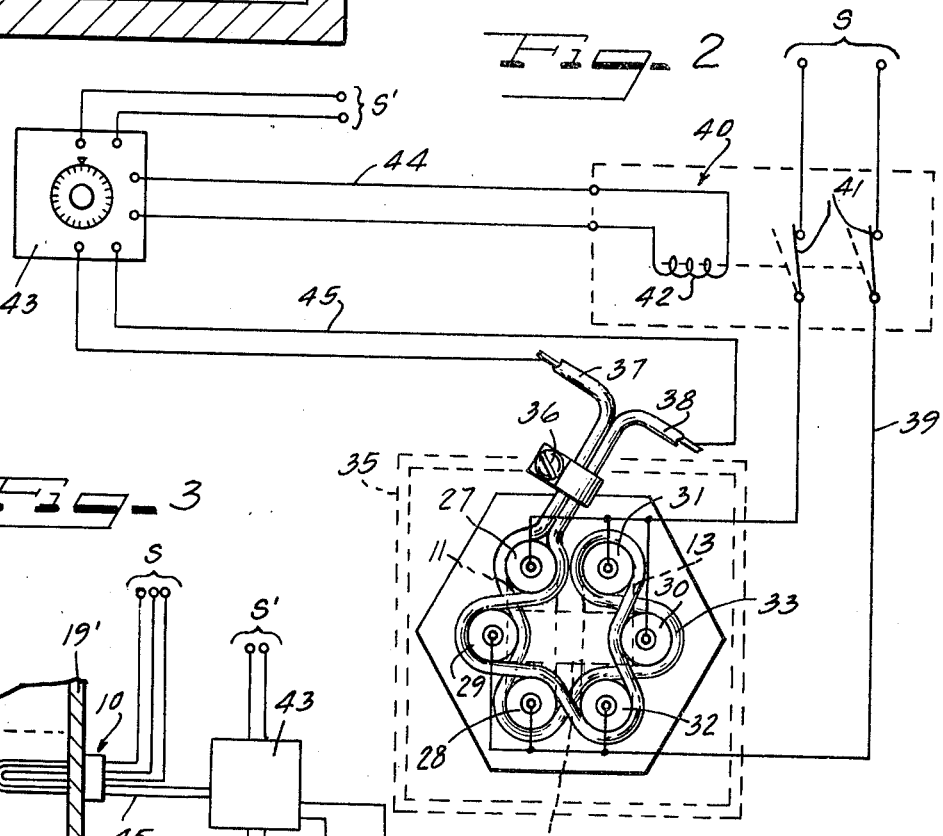
FIG. 2 is a schematic wiring diagram depicting connecting circuitry to the heater and to the rope-type sensor interwound about sheath portions of heating elements of the heater.

As shown in FIG. 2, a flexible, rope-type sensor 33 is interwoven about the outer portions **26*a* and 26*b* of the legs 24*a* and 24*b* in a overlapping array such that a substantial portion of the outer circumferential surface of each of the outer leg portions 2*a* and 2*b* is in contact with the rope-sensor 33. By use of this overlapping array, any out-of-limit temperature of the elements 11, 12 and 13 will be quickly sensed by the sensor 33.**

The mounting plug or flange 14 carries an outer end mounting flange 34 which in turn supports a box-shaped enclosure 35 covering the terminals 27–32, the sensor 33 and the outer portions **26*a* and 26*b* of the legs 24*a* and 24*b*. To the mounting flange 34 is screwed a holding bracket 36 positioned to hold opposite end leads 37 and 38 of the sensor 33 side-by-side so that the sensor 33 is maintained thoroughly wrapped in contact with the outer portions 26a and 26b of the legs 24a and 24b of elements 11, 12 and 13.**

With the heater 10 so installed, the terminals 27–32 are connected to a source of power S through a power circuit 39. A power relay 40 having normally open contacts 41 in series with the terminals 27–32 and the power supply S is activated by a solenoid 42 which is in turn connected to a controller 43 by a relay circuit 44. The controller 43 is likewise connected to a power source S' and to the leads 37 and 38 of the sensor 33 by a control circuit 45.

If the sensor 33 senses an out-of-limit condition, i.e. temperature exceeds a normal upper limit, the condition is transmitted to the controller 43 which in turn opens the circuit 44 to the solenoid 42 causing the contacts 41 to open, shutting off the power to the heater 10.

In a like manner, if the sensor 33 senses an out-of-limit condition, i.e. temperature exceeds a normal lower limit, this condition is transmitted to the controller 43 which in turn energizes the solenoid 42 through the relay circuit 44 which in turn closes the contacts 41 and energizing heater 10.

Figure 3:
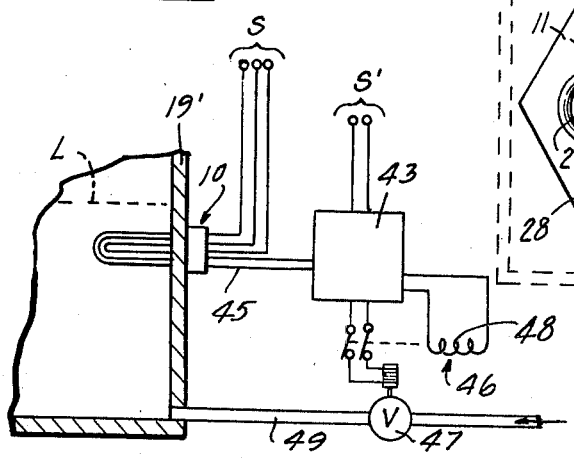
FIG. 3 is a schematic wiring diagram depicting an alternate use of the heater and sensor to control an inlet valve.

As shown in FIG. 3, the controller 43 can be connected through appropriate circuits and a supply valve relay 46 to a liquid supply control valve 47. While liquid level L is above the heater 10, it remains within acceptable temperature limits, but when the level drops below the heater or at least a part of the heater, self-generated, out-of-limit heat of the heater is sensed by the sensor 33. Immediately, the controller 43 is activated to operate the relay 46 to close an operating circuit to valve-actuating solenoid 48 to open the valve 47 and thereby opening a liquid replenishing line 49 into the tank 19'.

While various modifications may be suggested by those versed in the art, it should be appreciated that I wish to embody within the scope of the patent warranted herein, all such modifications as reasonably and properly come within the scope of my contribution to the art.

I claim as our invention:

1. An electrically energized control system for substantially maintaining a predetermined condition in respect to a liquid within a receptacle comprising:

a. an immersion-type heater carried by said receptacle and having an inner portion extending inwardly into said receptacle to contact said liquid and an outer portion extending outwardly from said receptacle, b. sensor means carried by said outer portion of said heater for sensing an excessive self-generated temperature of said heater caused by an undesirable deviation from said predetermined condition, c. means controlled by said sensor for effecting return to said predetermined condition, and further characterized by said means controlled by said sensor comprising an electrical power supply means further comprising a power circuit, an electrical power source, and a power relay, said power source connected to said heater by said power circuit through said power relay and to energize said heater, a control circuit connecting with said sensor means, a controller means connected to said control circuit and responsive to an output from said sensor means, a second electrical power source connected to said controller means to energize said controller, and a power relay circuit to activate said power relay and connected to said relay and said controller means, wherein said heater is selectively energized by said power source when said relay is activated by said controller means in response to said sensor.

2. An electrically energized control system for substantially maintaining a predetermined condition in respect to a liquid within a receptacle comprising:

a. an immersion-type heater carried by said receptacle and having an inner portion extending inwardly into said receptacle to contact said liquid and an outer portion extending outwardly from said receptacle, b. sensor means carried by said outer portion of said heater for sensing an excessive self-generated temperature of said heater caused by an undesirable deviation from said predetermined condition, c. means controlled by said sensor for effecting return to said predetermined condition, and further characterized by, said inner portion of said heater comprising a set of U-shape heating elements having two inner leg portions and a connecting loop portion joining with said leg portions and said outer portion comprising an outer leg portion of said U-shape elements having at an end therof a terminal prepared for connection to a power circuit, said heater further including a solid cylindrical-shaped mounting plug having an outer gripping portion in an outer end and a threaded portion at an inner end, said threaded portion prepared for engaging with a wall of said receptacle, said plug containing said leg portions of said elements positioned parallel to the longitudinal axis of said plug, and said sensor means comprising a sensor being flexible and rope-type, engaging said outer leg portions of said heating elements.

3. An electrically energized control system as defined by claim 2 and further characterized by, said set of heating elements comprising a first, second and third element mounted in said plug to form a radially disposed hexagon array about the longitudinal axis of said plug, said first and third element respectively located an equal and opposite distance from the vertical axis of said plug and said second element located on the horizontal axis having leg portions an equal distance from said vertical axis, said sensor having a body portion engaging said outer leg portions of said elements in a reversing and overlapping array to contact a substantial outer area of said leg portions, and ends forming leads and being selectively held in close proximity so as to contact the outer portion of one of said legs.

4. A control system according to claim 1 and further characterized by said system comprising:

an electrically activated supply valve, said valve connected to a bottom portion of said receptacle to allow said liquid to enter into said receptacle when in an open condition and prevent said inflow when in a closed condition, a valve control means comprising a valve circuit, a valve control relay having contacts connected in said valve circuit between said first power source and said valve and having a solenoid for activating said contacts, a valve controller connected to said second power source and having input means connected to said sensor means and output means operatively connected to said solenoid of said relay, wherein upon said sensor sensing a temperature exceeding an upper out-of-limit condition transmits a response to said controller means which in turn activates said control relay to place said control valve in an open position.

5. An electrically energized immersion-type heater for use within a receptacle containing a liquid comprising, mounting means for engaging with said receptacle, heating means to generate heat, said means contained by a mounting means and having an inner portion prepared to extend within said receptacle and an outer portion to extend outwardly therefrom, terminal means for connection to a source of electrical power and carried at an end of said outer portion of said heating means, and electrically insulated therefrom, and sensor means to sense a temperature of said heating means and carried by and in contact with said outer portion of said heating means.

6. An electrically energized immersion-type heater as defined by claim 5 and further characterized by, said mouting means comprising a cylindrical-shaped mounting plug having a gripping portion at an outer end and a threaded portion for engagement with said receptacle at an inner end, said inner portion of heating means comprising a set of U-shaped heating elements having two inner leg portions and a connecting loop portion joining with an inner end of said inner leg portions and said outer portion comprising an outer leg portion of said U-shaped element and having at an outer end thereof said terminal means, said legs contained in said plug and positioned parallel to the longitudinal axis of said plug.

7. An immersion-type heater as characterized by claim 6 and further defined by said heater comprising:

a mounting flange having a flat rectangular body and a set of circular holes therethrough prepared to receive said outer leg portions of said elements respectively, said holes radially disposed in a hexagon array about the center axis of said body, said flange positioned and carried by said plug perpendicular to the longitudinal axis of said plug adjacent to the gripping portion of said plug, said flange prepared for securing a cover, a box-shaped cover being dimensionally similar to said mounting flange and mounted thereto to protect the sensor means and outer leg portions of said elements, said set of elements comprising a first, second and third element, a plane defined by said leg portions of said first element being parallel to and located a selective distance to one side of said vertical axis of said plug, a plane defined by said leg portions of said third element being parallel to and located an equal selected distance to the other side of said vertical axis, a plane defined by said leg portions of said second element being aligned with the horizontal axis of said plug, each leg of said second element being an equal distance to each side of said vertical axis, said set of elements forming a radial hexagon array about said horizontal and vertical axis of said plug, and said sensor being of a flexible, rope-type form having a body portion and end portions forming leads, said body portion arranged in an overlapping array about said outer leg portions of said elements to interface with a substantial area of said outer leg portions, said end portions of said sensor selectively held in close proximity so an adjacent body portion of said sensor is in contact with one of said outer leg portions.

8. An electrically energized immersion-type heater as defined by claim 5 and further characterized by, said sensor means being a flexible, rope-type form and being arranged in a reversing and overlapping array about said outer portion of said heating means.

* * * * *

UNITED STATES PATENT AND TRADEMARK OFFICE

CERTIFICATE OF CORRECTION

PATENT NO. : 4,037,080

DATED : July 19, 1977

INVENTOR(S) : Donald R. Owen

It is certified that error appears in the above-identified patent and that said Letters Patent are hereby corrected as shown below:

In the Abstract -- Line 1, after "a" read --reversing and --;

Column 2, line 57, for "2a and 2b" read --26a and 26b--.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*